US007893844B2

(12) United States Patent
Gottlieb

(10) Patent No.: US 7,893,844 B2
(45) Date of Patent: Feb. 22, 2011

(54) FALL DETECTION SYSTEM HAVING A FLOOR HEIGHT THRESHOLD AND A RESIDENT HEIGHT DETECTION DEVICE

(76) Inventor: Mark Gottlieb, 8625 Hampton Way, Fairfax Station, VA (US) 22039

( * ) Notice: Subject to any disclaimer, the term of this patent is extended or adjusted under 35 U.S.C. 154(b) by 245 days.

(21) Appl. No.: 12/216,053

(22) Filed: Jun. 27, 2008

(65) Prior Publication Data

US 2009/0322548 A1 Dec. 31, 2009

(51) Int. Cl.
*G08B 23/00* (2006.01)

(52) U.S. Cl. ..... 340/573.1; 340/539.12

(58) Field of Classification Search ..... 340/573.1, 340/573.7, 539.12, 539.13; 702/150; 600/587
See application file for complete search history.

(56) References Cited

U.S. PATENT DOCUMENTS 6,160,478 A * 12/2000 Jacobsen et al. ..... 340/539.12
6,333,694 B2 * 12/2001 Pierce et al. ..... 340/573.1

FOREIGN PATENT DOCUMENTS

EP 1642248 B1 * 3/2007

* cited by examiner

*Primary Examiner*—Jeffery Hofsass
(74) *Attorney, Agent, or Firm*—Davidson Berquist Jackson & Gowdey, LLP

(57) ABSTRACT

A system for tracking a location of a resident includes a resident height detection device (e.g., a small pendant, bracelet or other wearable device) and a receiver/dialer. When the system detects that the resident height detection device has remained within a threshold distance of the floor (e.g., 8 to 16 inches) for more than a given period of time (e.g., 15 seconds), an alarm condition signal would then be sent to a receiver/dialer elsewhere in the residence which would then forward an emergency signal to a caretaker or to an emergency operator by way of the receiver/dialer. The resident height detection device may further include an override switch to turn off tracking when the resident intends to be on the floor for an extended period of time.

50 Claims, 6 Drawing Sheets

FALL DETECTION SYSTEM HAVING A FLOOR HEIGHT THRESHOLD AND A RESIDENT HEIGHT DETECTION DEVICE

FIELD OF INVENTION

The present invention is directed to a method and system for detecting and reporting that someone has fallen and may be in need of emergency assistance, and in one embodiment to a wearable device for detecting and reporting a distance that the device is from floor-level.

DISCUSSION OF THE BACKGROUND

Of the 35 million Americans over 65, about 1 in 3 will fall in a given year, and 50% of those people who fall require assistance from someone else to get up. Seniors are hospitalized for fall-related injuries 5 times more often than they are for injuries from all other causes. Falls are the leading cause of accidental death for seniors.

Research shows that getting prompt help makes surviving an emergency more likely. The ability to get help also boosts the odds that a senior will continue to live independently. The longer a person spends helpless, the greater the likelihood he/she will be discharged into supportive care. For elderly people who live alone, becoming incapacitated and unable to get help is a common event, which usually marks the end to their ability to live independently. After a fall or other emergency, 90% of people who get help within one hour will continue independent living, but after 12 hours down only 10% of people will continue to live at home.

Fall detectors currently exist and can be split into two categories: shock detection and orientation sensing. The first category relies on the unit to experience a shock to trigger the event. The second category usually uses a tilt switch (mercury switch) and requires the object worn on the person to be oriented such that when they are in the horizontal position it triggers the tilt switch.

However, shock can be received by a shock sensor worn on the person when just bumping into a counter while walking around the home. Also, when one has a serious event (e.g., a sudden cardiac arrest), the person may not fall violently to the ground. Instead, the person may just collapse slowly to the ground thereby not triggering the shock sensor. The tilt sensor also has the drawback that it must be disabled each time the person wants to lie down (e.g., to take a nap or go to bed for the evening).

BRIEF DESCRIPTION OF THE DRAWINGS

The following description, given with respect to the attached drawings, may be better understood with reference to the non-limiting examples of the drawings, wherein.

DISCUSSION OF THE PREFERRED EMBODIMENTS

Figure 1:
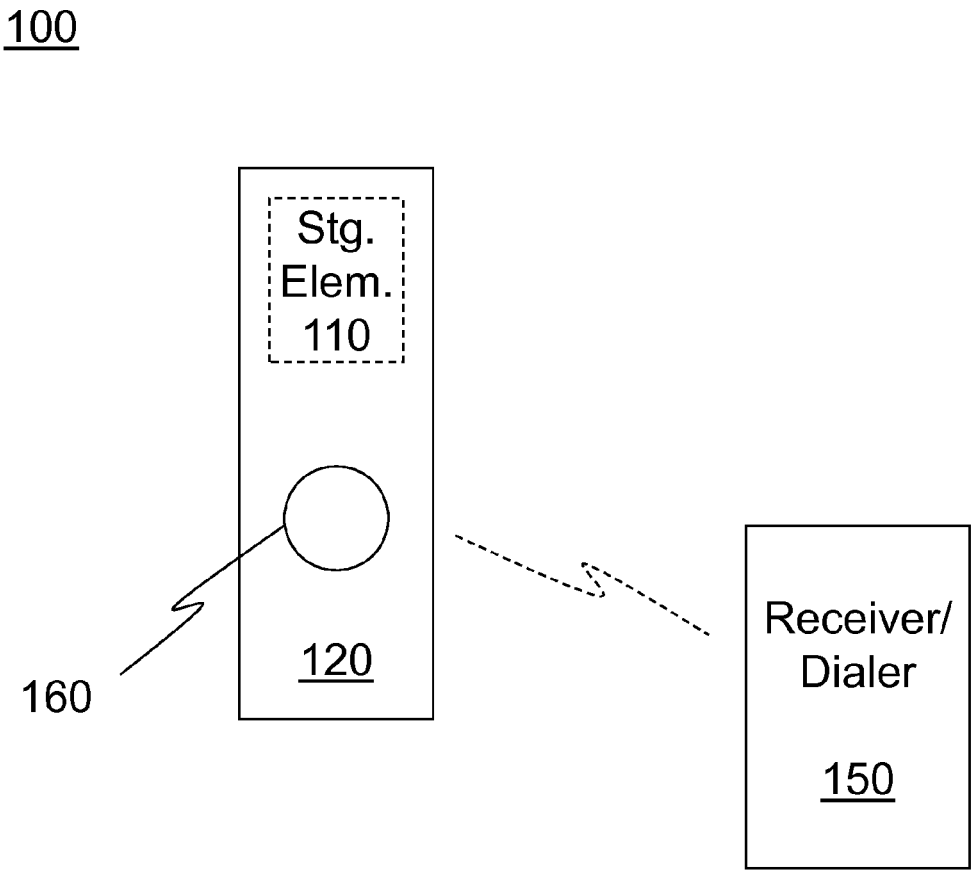
FIG. 1 is an illustration of a resident height detection device communicating with a receiver/dialer in order to report when a resident may have fallen.

Turning to FIG. 1, a system 100 includes a resident height detection device 120 that communicates wirelessly with a receiver/dialer 150 for tracking a height of the resident height detection device 120. In one embodiment, the resident height detection device 120 is a small pendant, bracelet or other wearable device that receives at least height information from any one or from a combination of the location information sources discussed below. In the embodiment shown in FIG. 1, the resident height detection device 120 includes a floor height storage element 110 which stores the floor height of at least one floor in the residence such that the resident height detection device 120 can autonomously determine its own height above the floor. When the resident height detection device 120 detects that it has remained within a threshold distance of the floor (e.g., 8 to 16 inches) for more than a given period of time (e.g., 15 seconds), it sends an alarm condition signal to a receiver/dialer 150 elsewhere in the residence (e.g., home, apartment, condominium, assisted living apartment, assisted living facility, nursing home, hospital room or boathouse) using a radio transmitted/receiver. The receiver/dialer 150 can then in turn forward an emergency signal to a caretaker or to an emergency operator.

Figure 2:
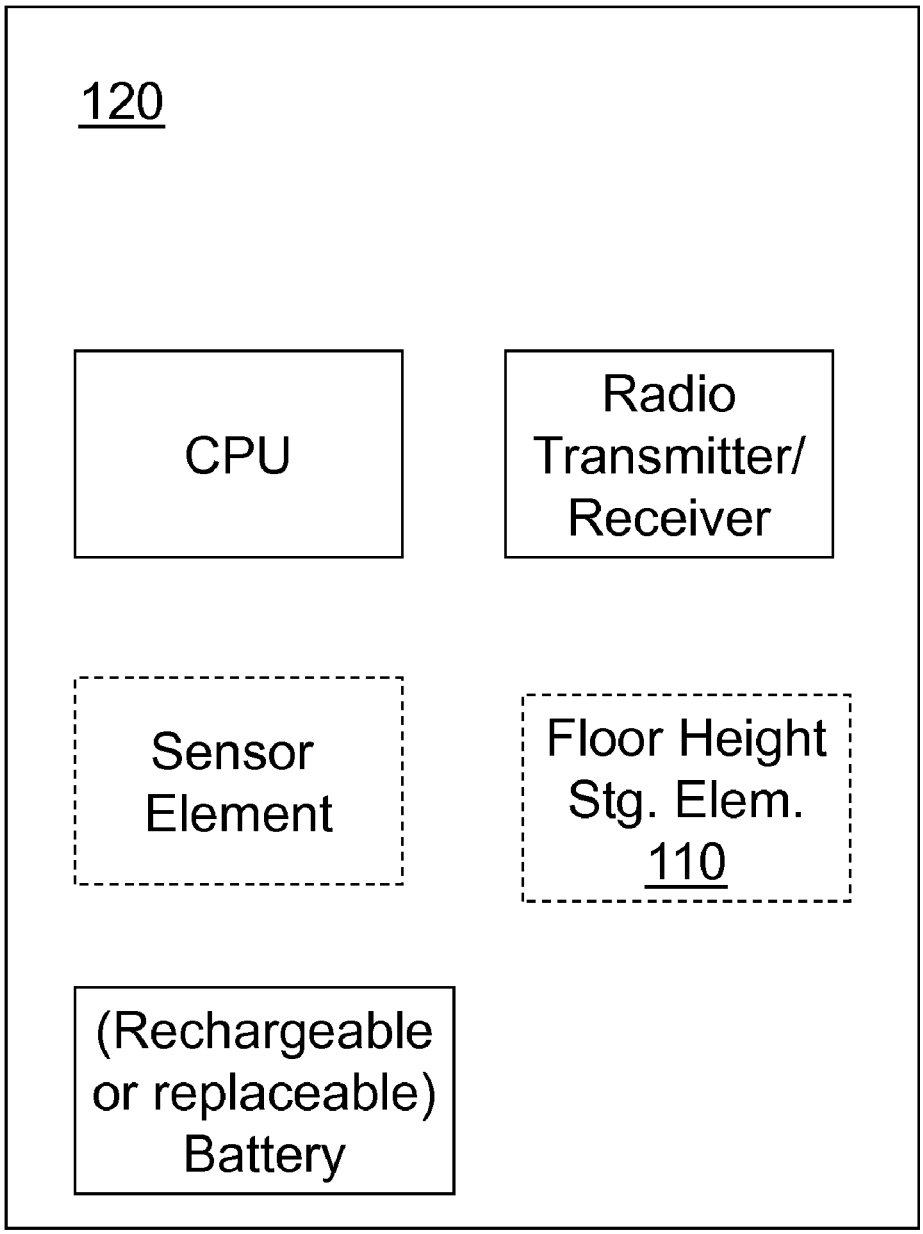
FIG. 2 is a block diagram of an exemplary resident height detection device.

As shown in FIG. 2, in one embodiment of the resident height detection device 120, the resident height detection device 120 is a small battery-powered device worn by the resident which could be worn in a variety of ways: in a pocket, on a lanyard, on the wrist, or clipped on a belt. The resident height detection device 120 includes: a battery (either replaceable/disposable or rechargeable), a sensor element for receiving height information (and potentially location information), a microprocessor (labeled as "CPU") and a radio transmitter and/or receiver. In one embodiment, the resident height detection device 120 determines, in conjunction with the floor height storage element 110 and the sensor element, whether it is within a threshold distance of the floor (e.g., 8 to 16 inches). This signifies the resident height detection device 120 is at the floor level, most like indicating that the person has fallen.

As shown in FIG. 2, the resident height detection device 120 may include at least one sensor element to determine its location such that it can determine (e.g., using a comparator, such as a logic circuit or a CPU and software) whether a person is in a 'fallen' condition. Exemplary sensors include, but are not limited to: (1) an altitude sensor, (2) a GPS sensor, (3) an RF sensor such as such as a GSM, BlueTooth or WiFi sensor and (4) a sonic or ultrasonic sensor. The use of those sensors will be described in additional detail below.

Figure 3:
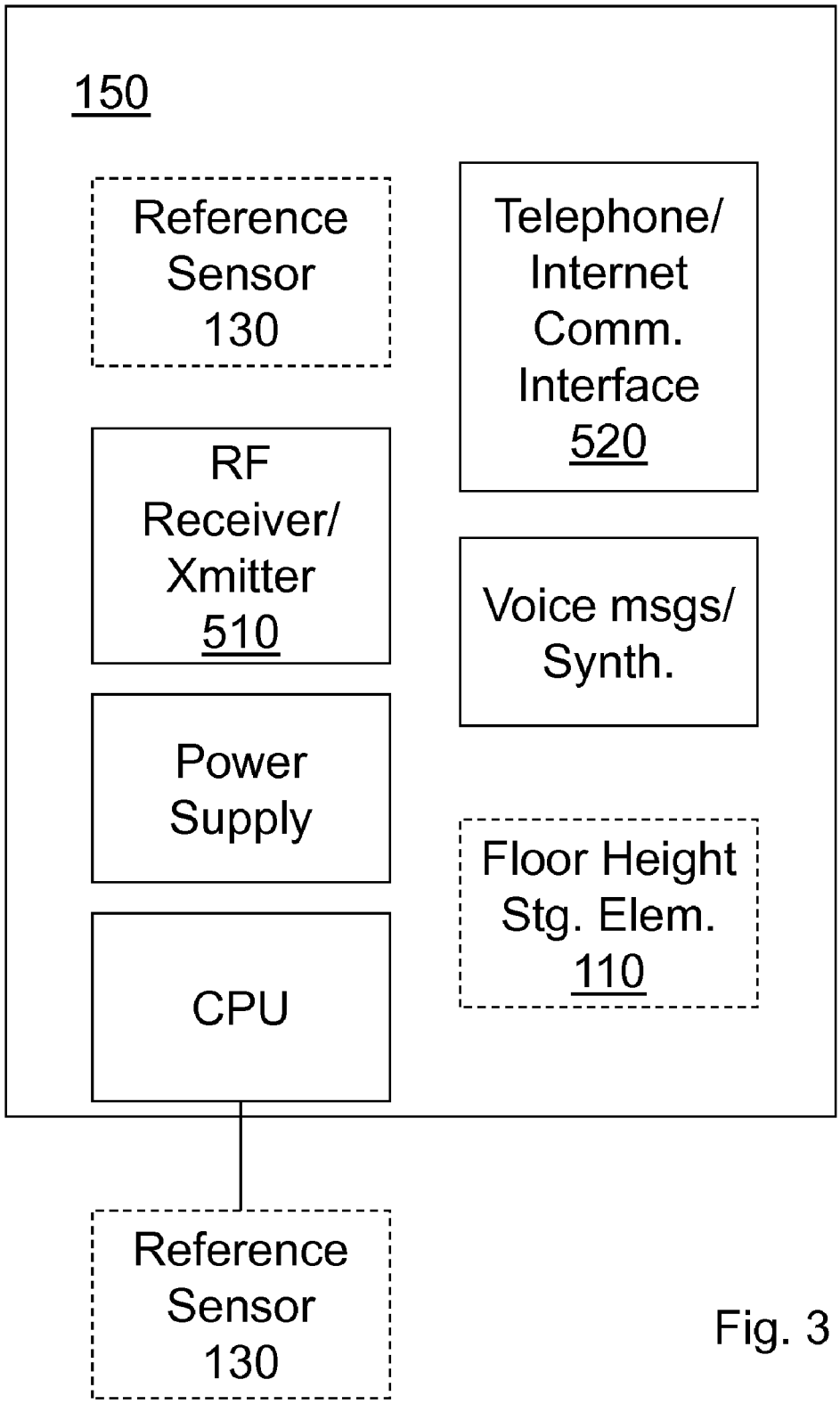
FIG. 3 is a block diagram of a receiver/dialer for identifying to third party that a resident has fallen.

As described above, in addition to the resident height detection device 120, the system 100 further includes a receiver/dialer 150 as shown in FIGS. 1 and 3. The receiver/dialer 150 can be located anywhere within the residence that can communicate with the resident height detection device 120. As shown in FIG. 3, the receiver/dialer 150 includes a housing surrounding an RF-receiver (e.g., a radio receiver) 510 for communicating with the resident height detection device 120, a power supply, a microprocessor, and a telephone/internet communications interface 520. When the resident height detection device 120 includes a floor height storage element 110, the RF receiver 510 can receive an alert event from the resident height detection device 120 when the resident height detection device 120 determines that the resident height detection device 120 is located below a threshold height.

As shown in FIG. 3, the receiver/dialer 150 includes a power supply, such as a transformer connected to an electrical outlet in the wall of the residence. The power supply may additionally include (or may exclusively include) a battery-based power source for use when electricity from an electrical outlet is either undesirable or unavailable.

When the receiver/dialer 150 receives an event signal indicative of a 'fallen' condition, the receiver/dialer 150 can initiate an outbound communications to a third-party using the telephone/internet communications interface 520. Such an interface may include, but is not limited to, any one or a combination of communications devices such as: a PSTN telephone device, a cellular telephone device, a cellular texting device, and internet communications device (e.g., a VoIP device or an instant messaging device). As used herein, third-parties can be any person contacted by the receiver/dialer 150, including, but not limited to, 911 emergency services, a monitoring service, a doctor's office, a nurse's station, an assisted living facility or hospital emergency/assistance desk, a friend or a relative. Alternatively, the receiver/dialer 150 may include, in addition or instead of the telephone/internet communications interface devices discussed above, an audible sound generator capable of alerting close neighbors.

In an embodiment of the receiver/dialer 150 including a telephone/internet communications interface, the receiver/dialer 150 attempts to contact help when the resident height detection device 120 determines that it is below the height threshold for a time greater than a threshold period of time. The receiver/dialer 150 may make one or more attempts to locate a family member, neighbor, front desk, caretaker, central monitoring station or the 911 emergency operator. The receiver/dialer 150 may dial numbers or otherwise attempt to contact help either in a pre-programmed order or in an order specified by the resident during configuration of the receiver/dialer 150. When contact is made, the receiver/dialer 150 can provide an indication of the problem (e.g., using recorded or synthesized speech) or using another audio or digital communication format.

As described above, the system 100 can determine the difference between a resident lying down on a sofa for a nap and lying on the floor. Thus, the resident can leave the resident location detector 110 on all day and night if desired.

Figure 4:
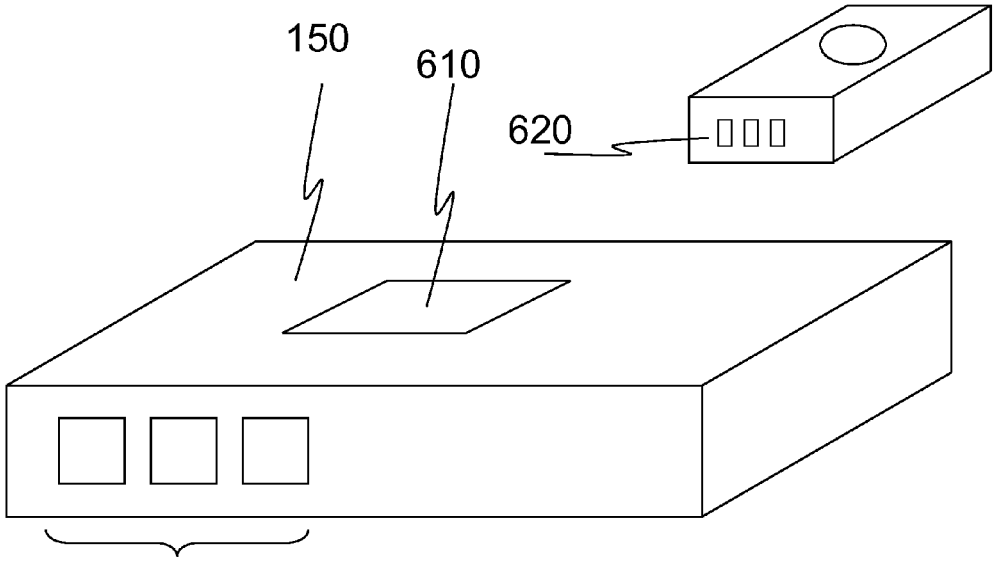
FIG. 4 is a schematic illustration of a receiver/dialer (including a communications interface and a charging port) and a resident height detection device (including charging and data leads)

As shown in FIG. 4, the receiver/dialer 150 may be implemented to include a cradle 610 for the resident height detection device 120. In one such embodiment, the cradle 610 is a physical holder for the resident height detection device 120 but does not include a charging capability or a data capability. In an alternate embodiment, the resident height detection device 120 includes a set of contacts 620 that interface with a corresponding set of contacts (not shown) in the charging cradle 610 and allow power to be passed between the resident height detection device 120 and the receiver/dialer 150. In yet another alternate embodiment, the resident height detection device 120 includes a set of contacts 620 that interface with a corresponding set of contacts (not shown) in the charging cradle 610 and allow power and/or data to be passed between the resident height detection device 120 and the receiver/dialer 150.

In the embodiment of the receiver/dialer 150 illustrated in FIG. 4, the receiver/dialer 150 further includes a set of user interface controls 650 (e.g., a set of buttons, switches or touch sensors) for controlling and/or configuring the operation of the receiver/dialer 150 and/or the resident height detection device 120. For example, a first user interface element may be activated to indicate that the resident height detection device 120 is currently placed at floor level on a first floor and the resident height detection device 120 should detect its own height and store it in the floor height storage element 110. In one such embodiment, the RF receiver 510 is replaced by an RF receiver/transmitter 510 and the resident height detection device 120 receives this request to program itself from the receiver/dialer 150 wirelessly using the RF receiver/transmitter 510. Alternatively, the resident height detection device 120 may receive a request to program itself via the set of contacts 620 while the resident height detection device 120 is in the cradle 610 but while the receiver/dialer 150 is not placed on the floor. In such an embodiment, the resident height detection device 120 would internally initiate a timer (or other count down or count up circuitry) and the resident would be required to place the resident height detection device 120 on the floor within that timer or countdown/countup period. At substantially the same time the timer in the resident height detection device 120 was started, the receiver/dialer 150 would also initiate a timer (or other count down or count up circuitry), and later the receiver/dialer 150 would provide the resident with visual and/or audio feedback indicating the end of that timer or countdown/countup period. Thus, the resident would know if the resident height detection device 120 had been placed on the floor level at the time the resident height detection device 120 took its measurement of the floor level for storage in the floor height storage element 110. The same process could be repeated for each additional floor level.

In an alternate embodiment, the floor height storage element 110 instead can be placed in the receiver/dialer 150. In such a configuration, the resident height detection device 120 need only send its current height to the receiver/dialer 150 and the receiver/dialer 150 can then in turn compare the received current height to the stored floor height to determine if the resident height detection device 120 is below the specified threshold. If so, then the receiver/dialer 150 can initiate an outbound communications using the telephone/internet communications interface 520 as described above.

As discussed above, the sensor element of the resident height detection device 120 can be any sensor capable of determining the current height of the resident height detection device 120. In an embodiment using an altitude sensor, the altitude sensor can be used to determine the height of the resident height detection device 120 height which can be compared against the floor level(s) stored in the floor height storage element 110. There are many altitude sensors that are quite accurate—being able to resolve down to less than one foot of elevation. An absolute pressure sensor (altimeter) could be used to determine absolute height or altitude. The corresponding circuitry uses the relationship between changes in pressure relative to altitude. This relationship is governed by the following equation:

$$h = \frac{(1 - (P/P_{ref})^{0.19026}) \times 288.15}{0.00198122}$$

where h is the indicated altitude in feet, P is the static pressure and $P_{ref}$ is the reference pressure. At sea level, the value $P_{ref}$=101325 pascals or 29.92126 inHg. Each foot of elevation decreases in pressure approximately 0.001 inHg.

Figure 5:
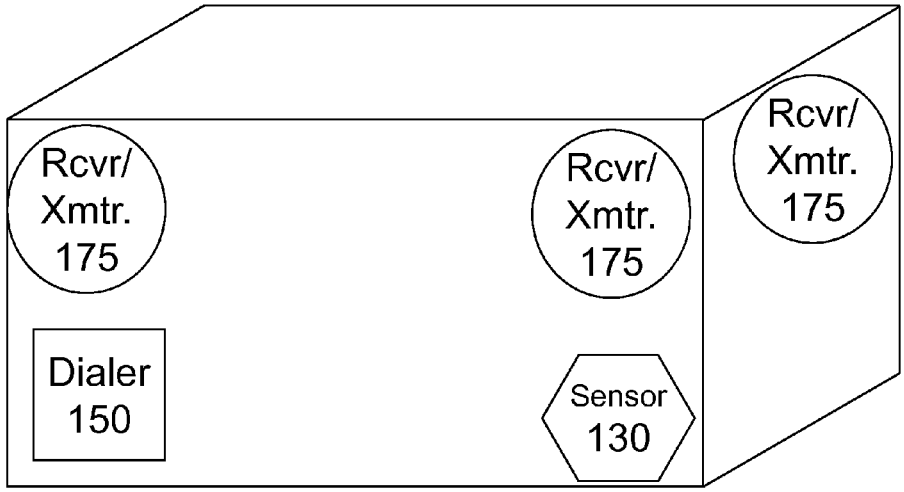
FIG. 5 is an illustration of a single-story residence in which plural known location receivers and/or transmitters are used to track the height of a resident height detection device.
Figure 6:
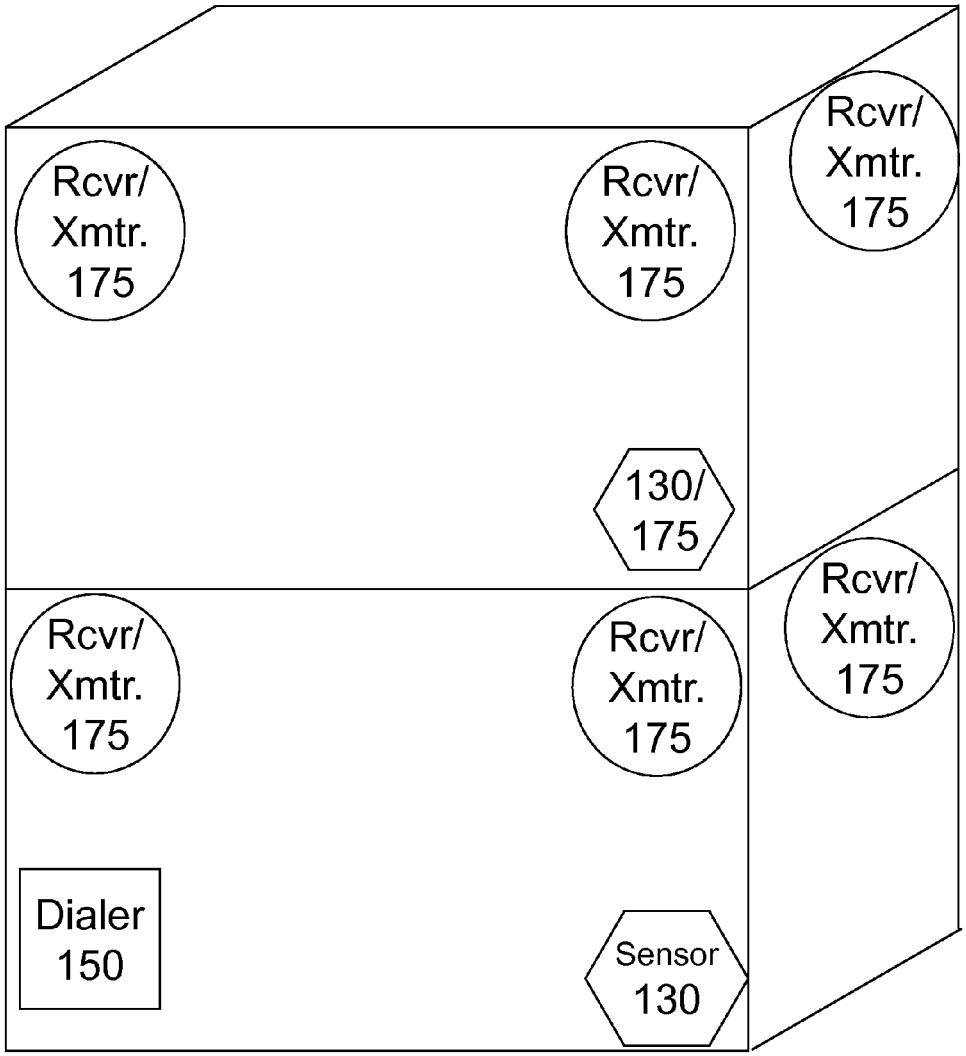
FIG. 6 is an illustration of a multi-story residence in which plural known location receivers and/or transmitters are used to track the height of a resident height detection device.

While such sensors may drift with environmental changes (e.g., temperature and humidity), such changes can be compensated for by including a reference sensor 130 in the home that is in a fixed position and/or provides reference measurements (e.g., relative altitude, temperature, and/or humidity). Accordingly, changes in environmental conditions would be compensated for, either by acting the same on both sensors (i.e., the one worn by the resident and the other in a fixed location in the home) or by including additional information on the environmental conditions. In one embodiment, the reference sensor 130 would be integrated into the receiver/dialer 150, as shown in FIG. 4. In another embodiment, the reference sensor 130 would be firmly attached to the wall at a threshold level (e.g., at the floor level), as shown in FIG. 5. As shown in FIG. 6, in a multi-story residence, one reference sensor 130 per level would be used to help determine if the resident is on the floor of any of the stories.

In one embodiment that addresses environmental changes and/or drift between sensors, the floor height storage element 110 is stored in the receiver/dialer 150 and the floor height storage element 110 is periodically loaded with a pressure measurement received from a reference sensor 130 located at the threshold height (or at a different, but known height such that a height measurements can be interpolated from pressure measurements). As the receiver/dialer 150 receives pressure measurements (indicating height information) from the resident height detection device 120, the receiver/dialer 150 can compare (e.g., using a comparator, such as a logic circuit or a CPU and software) the stored pressure measurement in the floor storage height detection device 110 with the received pressure measurement to determine if the resident height detection device 120 is in a 'fallen' condition.

In another embodiment, the floor height storage element 110 is stored in the resident height detection device 120 and the resident height detection device 120 receives a pressure value indicating a height of the reference sensor 130 from the receiver/dialer 150 when the resident height detection device 120 is placed in the cradle. This pressure value is then stored in the floor height storage element 110. This occasional calibration (i.e. during charging) helps to account for long term drift by matching the readings of the resident height detection device 120 and the reference sensor 130. Thus, if the resident height detection device 120 is charged once a week—the long term effects of drift in the two sensors could be cancelled out each time the unit is charged. The reason to do this at charging is that at charging, both sensors are at the same elevation (or a known relative elevation)—and thus can be synced together.

In an embodiment of the system 100 that uses a pressure sensor/altimeter, the receiver/dialer 150 may further include a reference sensor 130 to be used as a reference for the pressure sensor/altimeter in the resident height detection device 120. If this receiver/dialer 150 is fixed at a certain known height above the floor level, the system will then know the elevation to watch for from the resident height detection device 120 for the floor level. To set this height, the resident may press a corresponding control of the set of user interface controls 650 and then use one or more other controls to increase or decrease a displayed (or spoken) value which will be remembered as the height of the reference sensor 130 in the receiver/dialer 150.

As shown in FIG. 3, the reference sensor 130 may instead of (or in addition to) being mounted internal to the receiver/dialer 150 be mounted external to the receiver/dialer 150 and connected thereto using a cable. In such a configuration, the reference sensor 130 would preferably be mounted at a predetermined height (e.g., 1 foot) from the floor so as to avoid having to specify the height of the receiver/dialer 150.

Alternatively, a GPS sensor can be used in at least two different ways as a sensor element. In a first technique, a GPS sensor provides an absolute altitude. In a second technique, the GPS sensor provides a relative altitude, e.g., relative with respect to another GPS sensor such as a reference sensor 130 (which is at a known height).

Figure 7:
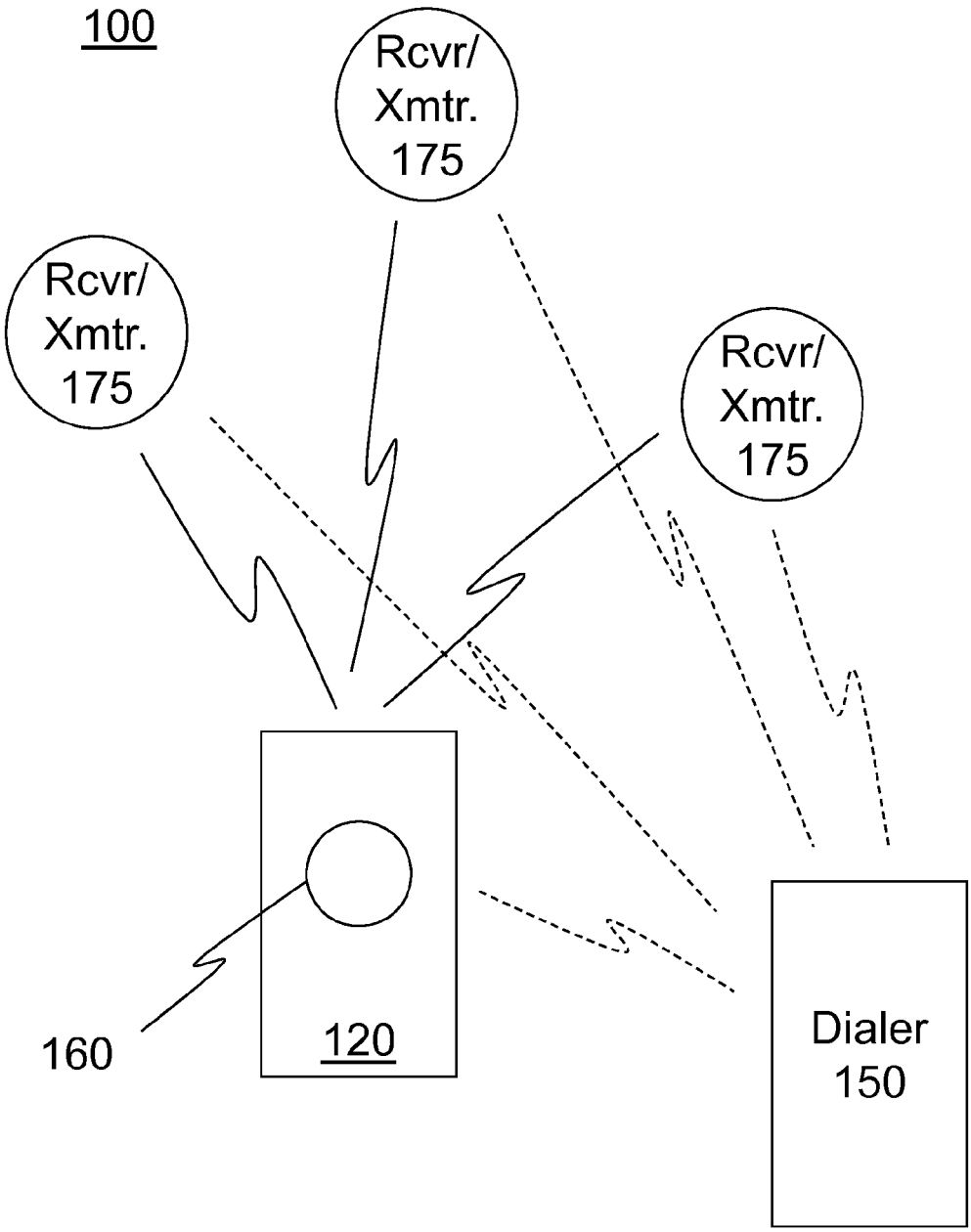
FIG. 7 is an illustration of a resident height detection device performing triangulation using known location transmitters/receivers.

GSM, Blue Tooth and WiFi detector systems may also be used for detecting a height by closely monitoring the received signal strength from several known location transmitters and/or receivers 175, as shown in FIGS. 5 and 6. As shown in FIG. 7, in a configuration where the known location transmitters and/or receivers 175 are transmitters, the known location transmitters 175 emit a signal that the resident height detection device 120 can use to triangulate its height and/or position. In a configuration where the known location transmitters and/or receivers 175 are receivers, the known location receivers 175 receive a signal from the resident height detection device 120 that can use be used to triangulate its height and/or position. Typically such triangulation is performed by triangulation circuitry (e.g., either custom circuitry or a CPU and software) by measuring signal strength from the known location transmitters and/or receivers 175 and/or arrival times of signals at either the resident height detection device 120 or at the location transmitters and/or receivers 175. The received information also can be compared with information based on a previously generated map of the signal strengths at different points in the home or apartment. The resident height detection device 120 and the known location transmitters and/or receivers 175 may also use bidirectional communication to determine position of the resident height detection device 120. For example, when the known location transmitters and/or receivers 175 detect that the resident height detection device 120 has emitted a location signal, they each respond with their own reply signal. By measuring how long it takes to receive a response from each of the known location transmitters and/or receivers 175, the resident height detection device 120 can determine its position. Moreover, in a bidirectional communication embodiment, the transmission from the resident height detection device 120 to the known location transmitters and/or receivers 175 can utilize a first communication technique (e.g., RF) which the transmission from the known location transmitters and/or receivers 175 to the resident height detection device 120 utilizes a second communication technique (e.g., ultrasound).

In yet another alternate embodiment, sonic and/or ultrasonic sensors may also be used for sensing a height relative to the floor. In one such embodiment, location transmitters and/or receivers 175 would be arranged in various locations within the residence with one or more per room. The resident height detection device 120 would then emit a sonic or ultrasonic sound once every few minutes, and the location transmitters and/or receivers 175 would pick up the signal. In one embodiment, the location transmitters and/or receivers 175 would be connected in a closed network system and would compare the time it took each location transmitters and/or receivers 175 to pick up the signal. With the input from several sensors, the system would be able to triangulate or determine the position of the resident height detection device within a few inches. This would enable the system to determine if the resident height detection device 120 is within a given threshold distance of the floor. In a variation of this alternate embodiment, infrared transmitters and receivers can be used to triangulate the location of resident height detection device 120 in a similar fashion to the sonic method mentioned above. In another variation of this alternate embodiment, triangulation can be determined using ultra wide band (UWB) sensors and receivers instead of sonic/ultrasonic transmitters and receivers, again measuring the time difference of arrival of the signals to determine the location of the resident height detection device.

In the triangulation-based embodiments discussed above, the resident height detection device 120 can include the floor height storage element 110 such that it can determine itself if the resident height detection device 120 is in a 'fallen' condition. Alternatively, the floor height storage element 110 can be in the receiver/dialer 150 such that the receiver/dialer 150 determines if the resident height detection device 120 is in a 'fallen' condition by comparing height and/or location information from the resident height detection device 120 with a known height stored in the floor height storage element 110. In yet another embodiment, the floor height storage element 110 could even be in one of the known location transmitters and/or receivers 175 which would then report to the receiver/dialer 150 whether the resident height detection device 120 is in a 'fallen' condition.

The resident height detection device 120 may further include at least one auxiliary sensor to determine if it is being worn, thereby reducing false alerts. One such sensor is a movement sensor that would cause the resident height detection device 120 to determine that it is being worn when a movement (even slight) is detected (or several movements are detected within a specified period of time). An alternative sensor is a pulse detector. When the resident height detection device 120 is worn as a wrist strap or belt device, it could monitor the pulse of the resident. The absence of a pulse would mean the unit is not attached to the person again thereby avoiding false alerts.

Yet another auxiliary sensor is a heat detecting sensor. In this configuration, the resident height detection device 120 is placed in contact with any part of the skin. The device would then look for a surface temperature within range of a typical skin temperature of a human. Similarly, the touch-based heat sensor can be replaced with a location-sensitive infrared sensor.

In an alternate embodiment, the resident height detection device 120 and/or the receiver/dialer 150 may further include an audible alert generator which is triggered a threshold period of time before the receiver/dialer 150 triggers the communications interface 520 to request help. This gives the resident a chance to disable the outbound message (e.g., when the resident realizes that it is a false alarm). The alert generator may either disable the audible alert before establishing an outbound connection or may continue to generate the audible alert until a manual reset is received at either the resident height detection device 120 or the receiver/dialer 150. This would enable neighbors in the vicinity to hear the distress condition and come to the aid of the fallen person. Whether the alert generator requires a manual reset may optionally be specified on the receiver/dialer 150 or by interacting with the receiver/dialer 150 (e.g., using a physical switch (not shown) or by using touch tone communications or an internet connection to the receiver/dialer 150).

In another embodiment that is designed to avoid false alerts, the system 100 may include the ability to specify 'safe areas' where the person is able to lie down yet not trigger an alarm. Such places would the sofa, the bed and the bathtub. With enough accuracy in the system to determine such locations in and around the residence, the system the resident to be in a prone (lying down) position and not trigger an event. These safe areas would be set up in a learn-mode during installation of the system (e.g., as might be indicated by use of the set of user interface controls 650 as shown in FIG. 4). One advantage to such a configuration is a resident might have a bed that is very low to the ground and the resident would not need to remove the resident height detection device 120 each time he/she laid down. With this safe area approach—one could even use a tilt switch to be the main sensor to determine if the person is in a certain range of positions that indicate that the resident is generally in the prone position. Using that configuration, a prone position as determined by the tilt switch within a safe zone would not cause an alert, but a prone position outside of a safe zone would cause an alert. With a tilt switch, whenever the tilt switch is in a certain range of positions, the sensor indicates that the resident has fallen. However, as mentioned earlier, this approach may cause false alarms when the resident is taking a nap or lying in the bathtub.

The resident height detection device 120 may further include a sensor for determining if it is underwater. In one embodiment, a conductivity sensor is connected to two closely located metal contacts (e.g., a half inch apart) on the case. This way, if the resident is taking a bath the resident height detection device 120 would not send an event alert signal. This may be a necessary feature for the altimeter sensor since the person lying in a bathtub would appear to be at the elevation of the floor. This simple addition would prevent false alarms when in the bathtub.

In yet another embodiment, the resident height detection device 120 includes a switch (e.g., button) (160 in FIG. 1) that acts as a temporary override of the resident height detection device 120. When the switch is activated, the resident is identifying to the resident height detection device 120 and/or the receiver/dialer 150 that the resident is intentionally going to be lower than the threshold. For example, if a television's remote control has been accidentally kicked under the couch, the resident may have to lie on the floor to reach it. As this may take some time to reach, the resident can avoid a false alarm by activating the switch. In one embodiment, the number of times that the switch is activated in quick succession changes the length of time that the override is active. For example, a single activation overrides the sensor for 1 minute, two activations overrides the sensor for two minutes, etc. In another embodiment, the period of time that the switch is activated changes the length of time that the override is active. For example, holding the switch down for one second overrides the sensor for 1 minute, holding the switch down for two seconds overrides the sensor for two minutes, etc.

In a further configuration, the resident height detection device 120 may include voice circuitry (e.g., analog or digital) for carrying voice communications between at least one of (1) the resident height detection device 120 and the receiver/dialer 150 and (2) the receiver/dialer 150 and the resident height detection device 120. In such a configuration, in addition to being able to cause the receiver/dialer 150 to notify a third party about a potential emergency, the receiver/dialer 150 can (1) send voice received from the resident height detection device 120 to the third party (by way of the receiver/dialer 150) or (2) send voice received from the third party (by way of the receiver/dialer 150) to the resident height detection device 120 or (3) both send and receive voice communications.

In yet a further configuration, the resident height detection device 120 and the receiver/dialer 150 can be integrated into a single housing such that the resident height detection device 120 can call for help itself when a problem is detected. In such an embodiment, the communications interface can be any wireless communications interface (e.g., cellular, WiFi, WiMax or ZigBee) that will enable a notification of a third party. Such a configuration may further provide the transmission of voice to the third party, as described above.

While certain configurations of structures have been illustrated for the purposes of presenting the basic structures of the present invention, one of ordinary skill in the art will appreciate that other variations are possible which would still fall within the scope of the appended claims.

The invention claimed is:

1. A system for tracking whether a resident height detection device is below a threshold height in a residence, the system comprising:

a floor height storage element for storing threshold height information;

a resident height detection device for detecting height information related to a height of the resident height detection device;

a comparator for comparing the threshold height information and the detected height information to determine whether the residence height device is below a threshold height in a residence; and a housing including a communications interface for notifying a third party that the resident height detection device is below the threshold height in the residence.

2. The system as claimed in claim 1, wherein the resident height detection device includes a sensor for determining the height of the resident height detection device.

3. The system as claimed in claim 2, wherein the resident height detection device includes a sensor for determining a height of the resident height detection device relative to a floor of the residence.

4. The system as claimed in claim 2, wherein the resident height detection device includes a sensor for determining an absolute height of the resident height detection device.

5. The system as claimed in claim 2, wherein the sensor comprises a pressure-based altitude sensor.

6. The system as claimed in claim 5, further comprising a reference sensor for providing a reference signal indicative of a known height in the residence.

7. The system as claimed in claim 6, wherein the reference sensor is integrated into the housing.

8. The system as claimed in claim 6, wherein the reference sensor is external to the housing and coupled to the housing wirelessly.

9. The system as claimed in claim 6, wherein the reference sensor is external to the housing and coupled to the housing using a wired connection.

10. The system as claimed in claim 5, further comprising a reference sensor for indicating at least one environmental characteristic that can affect the pressure-based sensor.

11. The system as claimed in claim 10, wherein the reference sensor is integrated into the housing.

12. The system as claimed in claim 10, wherein the reference sensor is external to the housing and coupled to the housing wirelessly.

13. The system as claimed in claim 10, wherein the reference sensor is external to the housing and coupled to the housing using a wired connection.

14. The system as claimed in claim 2, wherein the sensor comprises a GPS-based sensor.

15. The system as claimed in claim 14, further comprising a reference sensor for providing a reference signal indicative of a known height in the residence.

16. The system as claimed in claim 15, wherein the reference sensor is integrated into the housing.

17. The system as claimed in claim 15, wherein the reference sensor is external to the housing and coupled to the housing wirelessly.

18. The system as claimed in claim 15, wherein the reference sensor is external to the housing and coupled to the housing using a wired connection.

19. The system as claimed in claim 14, further comprising a reference sensor for indicating at least one environmental characteristic that can affect the GPS-based sensor.

20. The system as claimed in claim 2, wherein the sensor comprises a triangulation-based sensor.

21. The system as claimed in claim 20, wherein the triangulation-based sensor comprises a sonic sensor.

22. The system as claimed in claim 20, wherein the triangulation-based sensor comprises an ultrasonic sensor.

23. The system as claimed in claim 1; wherein the resident height detection device further comprises a tilt switch.

24. The system as claimed in claim 2, further comprising plural known reference location transmitters for transmitting signals for determining the height of the resident height detection device.

25. The system as claimed in claim 24, wherein resident height detection device further comprises triangulation circuitry for triangulating the height of the resident height detection device from the signals received from the plural known reference location transmitters.

26. The system as claimed in claim 25, wherein the sensor comprises a sonic sensor.

27. The system as claimed in claim 25, wherein the sensor comprises an ultrasonic sensor.

28. The system as claimed in claim 25, wherein the sensor comprises an RF-based sensor.

29. The system as claimed in claim 1, wherein the communications interface comprises a PSTN dialer.

30. The system as claimed in claim 1, wherein the communications interface comprises a cellular telephone dialer.

31. The system as claimed in claim 1, wherein the communications interface comprises an Internet communications interface.

32. The system as claimed in claim 1, wherein the communications interface comprises a first communications interface and a second communications interface, wherein if an answer is not received using the first communications interface then the second communications interface is used.

33. The system as claimed in claim 1, further comprising a switch for temporarily overriding notifying the third party for a specified period of time.

34. The system as claimed in claim 33, wherein the specified period of time is based on a number of times that the switch is activated.

35. The system as claimed in claim 1, further comprising:

an audible alert generator for indicating that the dialer is ready to notify the third party that the resident height detection device is below the threshold height in the residence; and an override switch for canceling a notification of the third party.

36. The system as claimed in claim 1, further comprising a motion sensor for overriding notifying the third party when the resident height detection device is below the threshold height in the residence but the motion sensor does not sense motion.

37. The system as claimed in claim 1, further comprising a pulse detector for overriding notifying the third party when the resident height detection device is below the threshold height in the residence but the pulse detector does not sense a pulse.

38. The system as claimed in claim 1, further comprising a body heat detector for overriding notifying the third party when the resident height detection device is below the threshold height in the residence but the body heat detector does not sense body heat of the resident.

39. The system as claimed in claim 1, further comprising a water detector for overriding notifying the third party when the resident height detection device is below the threshold height in the residence but the water detector senses that the resident height detection device is in contact with water.

40. The system as claimed in claim 1, further comprising a memory for storing safe zone locations, wherein notifying the third party is overridden when resident height detection device is below the threshold height in the residence but the resident height detection device is within one of the safe zone locations.

41. The system as claimed in claim 1, wherein the housing further comprises a charging cradle.

42. The system as claimed in claim 41, wherein the resident height detection device further comprises contacts for charging the resident height detection device when placed in the charging cradle.

43. The system as claimed in claim 42, wherein the resident height detection device further comprises at least one data contact for passing information between the resident height detection device and circuitry within the housing.

44. The system as claimed in claim 2, further comprising plural known reference location receivers for receiving a signal for determining the height of the resident height detection device.

45. The system as claimed in claim 44, further comprising triangulation circuitry for triangulating the height of the resident height detection device from the signal received from the plural known reference location receivers.

46. The system as claimed in claim 1, further comprising voice circuitry for communicating voice signals between at least one of (1) the resident height detection device and the housing and (2) the housing and the resident height detection device.

47. The system as claimed in claim 1, wherein the floor height storage element, the resident height detection device and the comparator are stored within the housing.

48. The system as claimed in claim 47, wherein the communications interface comprises a cellular telephone dialer.

49. The system as claimed in claim 47, wherein the communications interface comprises a wireless Internet communications interface.

50. The system as claimed in claim 20, wherein the triangulation-based sensor comprises an RF-based sensor.

* * * * *